United States Patent [19]

Barbour

[11] Patent Number: 5,025,727

[45] Date of Patent: Jun. 25, 1991

[54] REPLACEABLE INK CARTRIDGE AND IMPRINTER

[75] Inventor: William P. Barbour, Laurel, Md.

[73] Assignee: Datacard Corporation, Minneapolis, Minn.

[21] Appl. No.: 542,192

[22] Filed: Jun. 21, 1990

[51] Int. Cl.[5] ..... B41J 3/04; B41F 1/46

[52] U.S. Cl. ..... 101/483; 101/269; 101/329; 101/333; 101/348; 101/479; 401/205; 427/428; 118/258; 118/264

[58] Field of Search ..... 101/369, 269, 329, 333, 101/334, 335, 103, 104, 348-349, 405, 479, 482, 48; 401/198, 199, 205, 207; 118/256, 258, 264; 427/428

[56] References Cited

U.S. PATENT DOCUMENTS

| | | | |
|---|---|---|---|
| 1,656,489 | 1/1928 | Low . | |
| 3,678,848 | 7/1972 | Roser et al. | 101/333 |
| 3,785,288 | 1/1974 | Hunter | 101/348 |
| 3,797,390 | 3/1974 | Marozzi | 101/333 |
| 3,804,016 | 4/1974 | Marozzi et al. . | |
| 3,859,915 | 1/1975 | Hunter | 101/103 |
| 3,921,524 | 11/1975 | Ritchie . | |
| 4,024,816 | 5/1977 | Williams et al. . | |
| 4,044,677 | 8/1977 | Hamisch, Jr. . | |
| 4,252,060 | 2/1981 | Strausburg . | |
| 4,267,772 | 5/1981 | Maitland | 101/103 |
| 4,440,083 | 4/1984 | Hooper . | |
| 4,484,827 | 11/1984 | Price, Jr. . | |
| 4,559,872 | 12/1985 | Perra, Jr. . | |
| 4,627,342 | 12/1986 | Yui | 101/329 |
| 4,697,517 | 10/1987 | Fassman et al. | 101/348 |
| 4,739,604 | 4/1988 | Natterer | 101/329 |
| 4,817,526 | 4/1989 | Winston | 101/329 |

*Primary Examiner*—Eugene H. Eickholt

*Attorney, Agent, or Firm*—Merchant, Gould, Smith, Edell, Welter & Schmidt

[57] ABSTRACT

A replaceable ink cartridge provides a means for replacing an ink roller on an imprinting device without soiling ones hands or clothes. The replaceable ink cartridge includes an ink roller which is received within and contained by a molded containment member prior to its insertion on an imprinting device. In addition, an imprinting device utilizing the replaceable ink cartridge and a method for replacing a replaceable ink cartridge without soiling ones hands or clothing are also provided.

18 Claims, 3 Drawing Sheets

FIG. 4
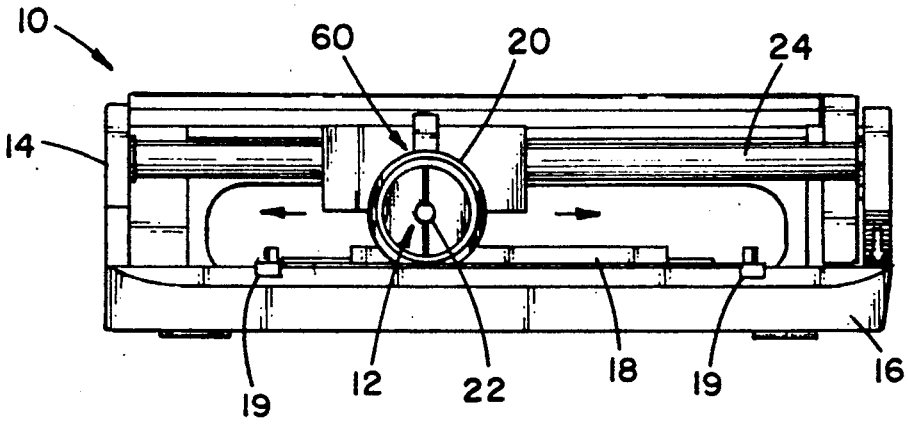
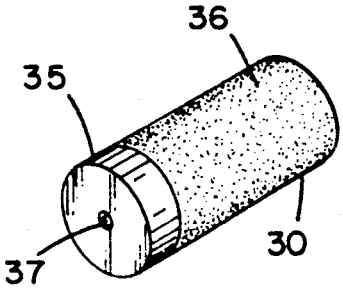
FIG. 5
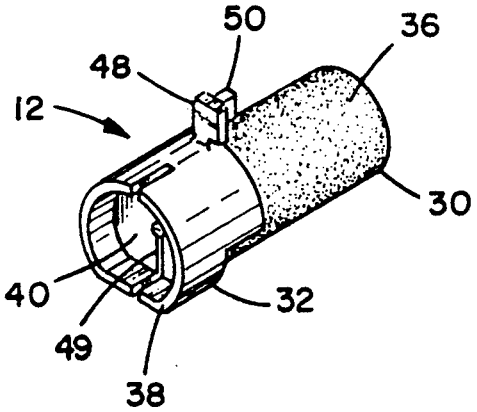
FIG. 6A
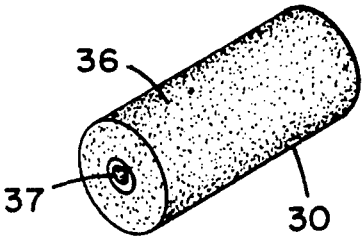
FIG. 6B
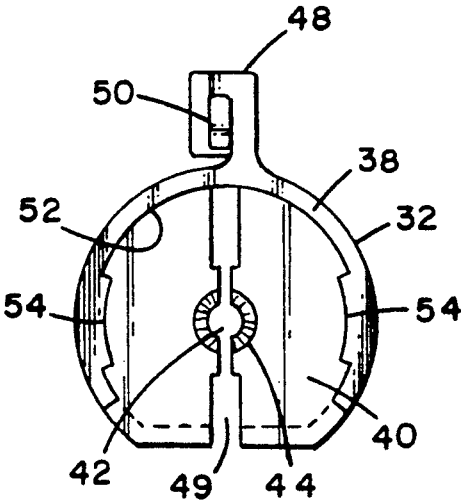
FIG. 7

REPLACEABLE INK CARTRIDGE AND IMPRINTER

BACKGROUND OF THE INVENTION

Various imprinting devices, such as imprinters for credit cards or other information containing members with raised characters, such as lettering and numbering, employ an ink roller to transfer an imprint of the raised characters to sheets of paper or other media, such as a customer billing or invoice. Over a period of time the ink rollers on these imprinting devices become exhausted of ink and must be replaced. Unfortunately, replacement of these ink rollers is a time consuming and messy process. Often, ink from the exhausted rollers as well as the new rollers ends up on the hands and clothes of the individual replacing the ink roller.

Given the short comings of presently available replacement ink rollers, it is clear that there has existed a long and unfilled need for a replaceable ink roller which can be removed and replaced on imprinting devices without transferring unwanted ink onto the hands and clothes of the individual changing the roller. In addition, a need exists for an imprinting device capable of utilizing such a replaceable ink roller.

SUMMARY OF THE INVENTION

Accordingly, it is an advantage of a preferred embodiment of a replaceable ink roller in accordance with the principles of the present invention to provide a replaceable ink cartridge which allows an individual to replace an exhausted ink roller without soiling his or her hands and clothes. In particular, the present invention provides a replaceable ink cartridge including an ink roller having an outer cylindrical surface and an ink cartridge containment means mounted to and containing a first end of the ink roller. The ink roller is composed of a porous matrix containing ink and includes a central bore running therethrough, the bore being configured to receive a roller shaft upon which the ink roller will rotate when mounted on an imprinting device.

The ink roller containment means, mounted to and containing the ink roller, includes a mounting means for mounting the replaceable ink cartridge on an imprinting device, a stabilizing means for maintaining the ink roller containment means in a stationary position while allowing the ink roller to freely rotate upon the roller shaft and a pry slot means for removing the replaceable ink cartridge from the roller shaft after it is exhausted. Preferably, the inside diameter of the ink roller containment means is sized to grip and contain the ink roller prior to its insertion on the roller shaft of the imprinting device. In addition, an end wall of the ink roller containment means includes a central aperture which engages one end of the ink roller shaft, thereby locking the replaceable ink cartridge securely on the imprinting device.

The present invention also provides an imprinting device for imprinting sheet media, the imprinting device being configured to accept a replaceable ink cartridge according to the present invention. Preferably, the imprinting device includes a housing having a base, a support surface mounted upon the base for supporting the sheet media and an information bearing member, such as a plastic card with raised characters, and a roller shaft mounted on the housing, the roller shaft being configured for insertion into the central bore of the ink roller, allowing the ink roller to rotate freely when in an operative state.

Furthermore, the present invention also provides a method or replacing a replaceable ink cartridge upon an imprinting device without soiling ones hands or clothing. In particular, a method is provided whereby an exhausted replaceable ink cartridge according to the present invention is removed by breaking the ink cartridge containment means. After discarding the exhausted ink roller, an individual can mount a new replaceable ink cartridge, including a nonexhausted ink roller, on the imprinting device without soiling his or her hands or clothing by grasping the replaceable ink cartridge by the ink cartridge containment means during the mounting procedure.

These and various other advantages and features of novelty which characterize the present invention are pointed out with particularity in the claims annexed hereto and forming a part hereof. However, for a better understanding of the invention, its advantages and objects attained by its use, reference should be had to the drawings which form a further part hereof and to the accompanying descriptive matter in which there is illustrated and described an embodiment of the invention.

BRIEF DESCRIPTION OF THE DRAWINGS

Referring now to the drawings in which like reference numbers represent corresponding parts throughout:

FIG. 4 is a front view of the hand-held imprinting device shown in FIG. 1;

FIG. 5 is a perspective view of a replaceable ink cartridge in accordance with the present invention;

FIG. 6A is a perspective view of an ink roller in accordance with the present invention;

FIG. 6B is a perspective view of another ink roller in accordance with the present invention;

FIG. 7 is a facing view of a molded containment member of a replaceable ink cartridge in accordance with the present invention, the view showing the portion of the molded containment member which contains the ink roller;

DETAILED DESCRIPTION OF A PREFERRED EMBODIMENT

Figure 1:
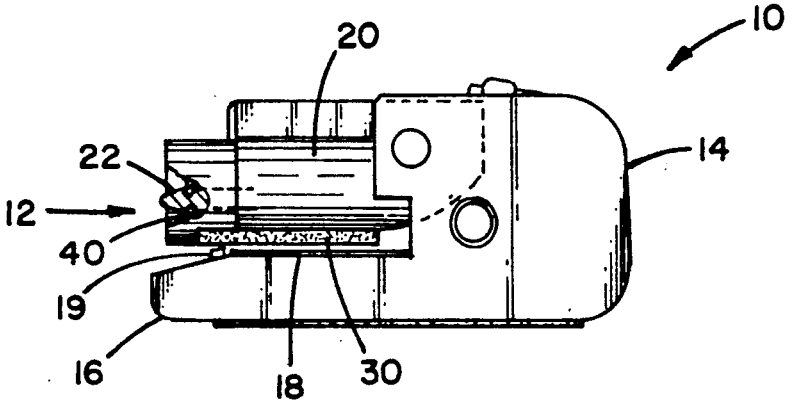
FIG. 1 is a first end view of a hand-held imprinting device employing a replaceable ink cartridge in accordance with the present invention.

Referring now to the drawings. FIGS. 1 through 4 respectively show views of a hand-held imprinting device 10 employing a replaceable ink cartridge 12 in accordance with the present invention. The imprinting device 10 includes a housing 14 having a base 16. A support surface 18 mounted on the base 16 is capable of supporting a plastic card with raised lettering or numbers, such as a credit or charge card, as well as various sheet media capable of being imprinted, such as a customer billing or invoice. In a preferred aspect, the imprinting device 10 also includes a pair of ramps 19 mounted on the base 16 proximate each end of the support surface 18. During imprinting, the ramps 19 serve to maintain the ink roller 12 in a fixed horizontal position at each end of the support surface 18 relative to the plastic card, such that the sheet media being imprinted will not be smudged with ink at each edge when the ink roller 12 is moved laterally.

The imprinting device according to the present invention 10 further includes an ink roller carriage 20 and ink roller shaft 22 slidably mounted upon an imprinting shaft 24. Both the ink roller carriage 20 and the roller shaft 22 cooperate to accept and retain the replaceable ink cartridge 12 when mounted on the imprinting device 10. Though the presently illustrated imprinting device does not contain transaction amount levers, such as for recording the amount of a purchase, it will be appreciated that such levers are also considered to be within the scope of the present invention.

Referring now to FIGS. 5 through 8, wherein is illustrated a preferred embodiment of a replaceable ink cartridge 12, including an ink roller 30 and a molded containment member 32 in accordance with the present invention. The ink roller 30 has a cylindrical surface and is composed of a porous matrix 36 capable of being saturated with ink. Typically, the porous matrix 36 is composed of a sintered material, such as sintered nylon or rubber. In addition, the ink roller 30 has a central bore 37 running therethrough, the bore being configured to receive the roller shaft 22 when the replaceable ink cartridge 12 is mounted on the imprinting device 10. In a preferred aspect, the ink roller 12 also includes a sleeve or tire 35, mounted to and containing one end of the ink roller 12. The tire 35 is configured to cooperate with the ramps 19 during imprinting such that the ends of the sheet media being imprinted are not smudged and the supporting surface 18 and base 16 of the imprinting device is not soiled with ink from the ink roller 30.

The molded containment member 32, which receives and contains the ink roller 30, has an outer cylindrical wall 38 and an end wall 40 proximate one end of the cylindrical wall 38. The end wall 40 further includes a central aperture 42 with a beveled edge 44 which receives and engages one end 45 of the roller shaft 22 as illustrated in FIG. 7. Once engaged, an undercut 46 in the roller shaft 22 engages the aperture 42 and locks the molded containment member 12 onto the end of the roller shaft. To assist in the engagement of the aperture 42 and roller shaft 22, a pry slot 49 extends radially from an exterior surface of the cylindrical wall 38 to the central aperture 42 contained in the end wall 40. In a particularly preferred aspect, the pry slot 49 extends radially from one exterior surface of the cylindrical wall 38, through the central aperture 42 of the end wall 40, and continues through at least a portion of the cylindrical wall 38 opposite the initial radial extension of the pry slot 49.

The molded containment member 32 further includes a stabilizing member 48 mounted upon the cylindrical wall 38. Typically the stabilizing member 48 includes a projection 50 which is received in a groove (not shown) in a rib 51 atop the ink roll cover 20. The stabilizing member 48 stabilizes the replaceable ink cartridge 12 relative to the imprinting device 10. In addition, once engaged, the stabilizing member 48 and projection 50 maintain the molded containment member 32 in a stationary position while allowing the ink roller 30 to rotate freely about the roller shaft 22.

Referring now particularly to FIG. 7, the interior surface 52 of that portion of the molded containment member 32 which receives and contains the ink roller 30, contains gripping surfaces 54, which project in towards the central aperture 42, and which serve to grip and contain the ink roller 30 prior to its insertion on an imprinting device 10. However, once the replaceable ink cartridge 12 is inserted on the imprinting device 10, the engagement of the roller shaft 22 with the central aperture 42 of the molded containment member 32 is sufficient to slightly spread apart the gripping surfaces 54, and to at least partially disengage the gripping surfaces 54 from containing the ink roller 30. Thus, the engagement of the replaceable ink cartridge 12 on an imprinting device 10 results in the molded containment member 32 being securely locked into a set position, while allowing the ink roller 30 to freely rotate about the roller shaft 22.

The molded containment member 32 may be made of any brittle plastic material such as styrene. Preferably, the molded containment member 32 will be formed with strategically located weakened areas so as to insure rupture at a pre-determined fracture site adjacent the pry slot 49 when the replaceable ink cartridge 12 is removed from the imprinting device 10. Thus, the replaceable ink cartridge 12 is configured such that it can only be removed from the imprinting device 10 by breaking the molded containment member 32.

Figure 2:
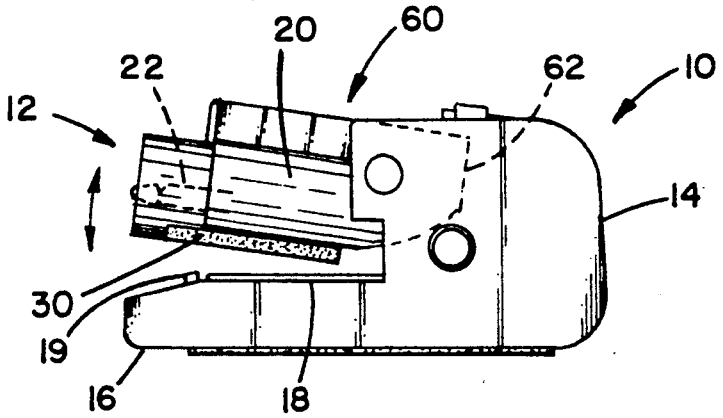
FIG. 2 is a second end view of the hand-held imprinting device shown in FIG. 1, with the ink roller cartridge in a raised position to allow the placement of sheet media and a plastic card into position for imprinting on the sheet media.
Figure 3:
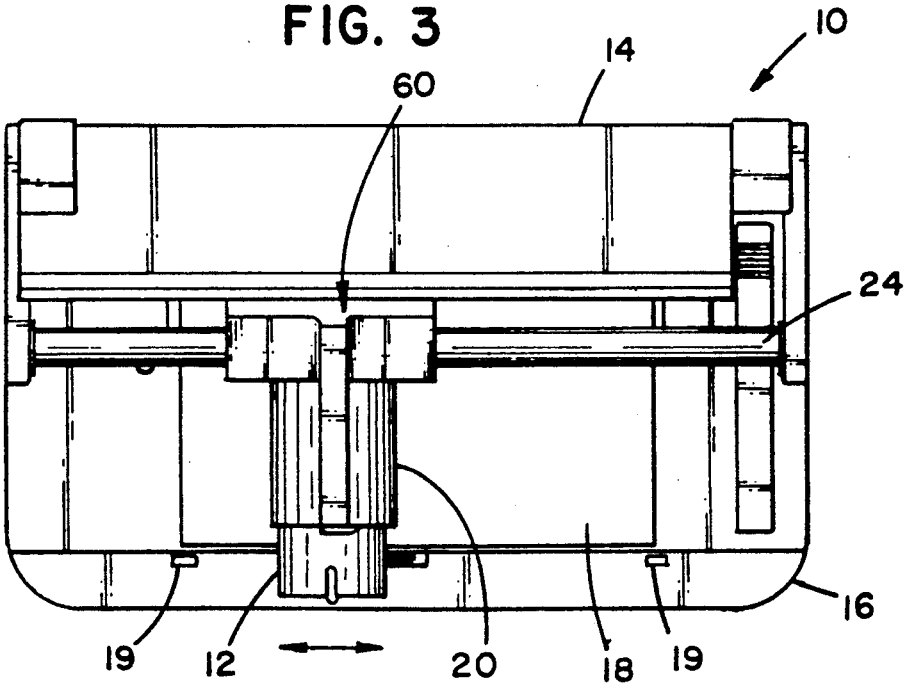
FIG. 3 is a top view of the hand-held imprinting device shown in FIG. 1.

Referring also now again to FIGS. 1 through 4, when the replaceable ink cartridge 12 in accordance with the present invention is mounted on the hand held imprinting device 10, a portion of the ink roller 30 extends below the ink roller carriage 20 to provide a contact point with sheet media and plastic card supported on the support surface 18. As illustrated in FIGS. 2 and 3, a combined imprinting member 60, being composed of the replaceable ink cartridge 12, ink roller carriage 20 and roller shaft 22, is slidably mounted upon the carriage shaft 24 of the imprinting device 10. In addition, as noted in FIG. 2, the imprinting member 60 is capable of being pivoted in an upward fashion to allow the insertion of a plastic card and sheet media to be imprinted.

In use, the imprinting member 60 of the imprinting device 10 is first pivoted into the upward position illustrated in FIG. 2. The plastic card and sheet media to be imprinted are then placed upon the support surface 18 of the imprinting device 10. Next, as illustrated in FIG. 1, the imprinting member 60 is lowered to an operative position. Finally, as shown in FIGS. 3 and 4, the imprinting member 60 can be laterally moved on the carriage shaft 24 of the imprinting device 10. Upon passing over the plastic card and sheet media supported upon the support surface 18, the pressure contact between the ink roller 30 and plastic card causes ink to exude from the porous surface 36 of the ink roller 30, and to thereby print indicia corresponding to the raised characters of the plastic card onto the sheet media. In addition, in a preferred aspect, the ramps 19 and tire 35 cooperate to maintain the ink roller 12 is a fixed horizontal position relative to the plastic card. Thus, the sheet media can be imprinted without being smudged with ink at each end, and the support surface 18 and base 16 of the imprinting device 10 will not be soiled with ink.

Figure 9:
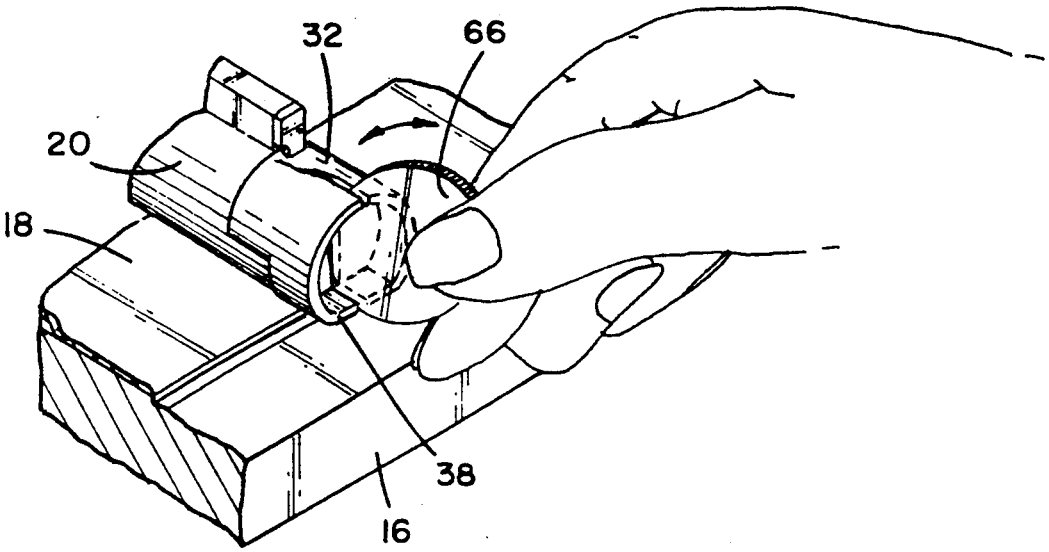
FIG. 9 is an illustration of the means for removing the replaceable ink cartridge from an imprinting device according to the present invention.
Figure 8:
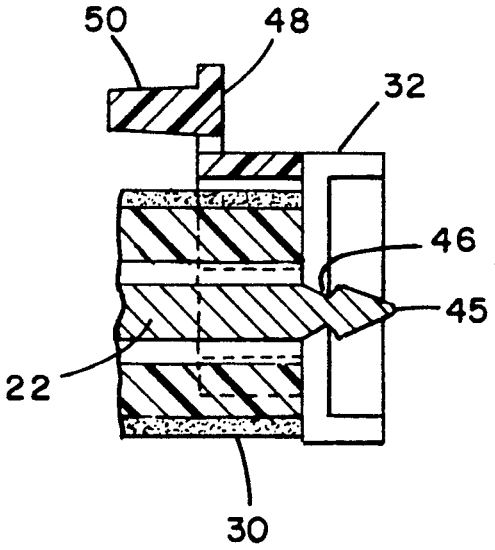
FIG. 8 illustrates a cross-section through the molded containment member, a portion of the roller shaft engaged in the central aperture of the molded containment member and a portion of the ink roller.

Referring also now to FIG. 9, the combination of the ink roller 30 mounted and contained within the ink roller containment member 32 provides the clean and convenient unitary replaceable ink cartridge 12 of the present invention. Utilization of the replaceable ink cartridge 12, in conjunction with a method for its replacement according to the present invention, allows an individual to replace the ink cartridge upon an imprinting device without soiling his or her hands. Specifically, an individual can remove an exhausted ink cartridge in accordance with the present invention by inserting a prying member, such as a coin 66, into the pry slot 49 of the molded containment member 32. Upon applying a twisting force to the coin 66, the cylindrical wall 38 of the molded containment member will break and release from the roller shaft 22 of the imprinting device 10. After discarding the used molded containment member 32, the hand-held imprinting device can be tilted over a trash receptacle, thereby allowing the exhausted ink roller 22 to fall into the trash receptacle without the need for the individual to handle the exhausted ink roller 22. To replace the exhausted ink cartridge, the individual simply grasps the unitary replaceable ink cartridge 12 by the molded containment member 32 and slides it onto the roller shaft 22, until the central aperture of the molded containment member 32 engages the undercut 46 of the roller shaft. Thus, an individual is capable of removing an exhausted ink cartridge and replacing it with a replaceable ink cartridge in accordance with the present invention without ever having to touch the ink rollers, and thereby avoids the soiling of his or her hands and clothes with ink.

It is to be understood that even though numerous characteristics and advantages of various embodiments of the present invention have been set forth in the foregoing description, this disclosure is illustrative only and changes may be made in detail to the full extent indicated by the broad general meaning of the terms in which the appended claims are expressed.

I claim:

1. A method for replacing an ink roller on an imprinting device without soiling ones hands or clothing comprising:

(a) removing an exhausted replaceable ink cartridge, including ink roller containment means and an ink roller, by breaking the ink roller containment means; and (b) replacing the exhausted replaceable ink cartridge with a new replaceable ink cartridge, wherein the new replaceable ink cartridge includes a nonexhausted ink roller, and further wherein an individual replacing the ink cartridge grasps the ink roller containment means during mounting.

2. A replaceable ink cartridge comprising:

a molded containment member having an outer cylindrical wall with an end wall proximate one end and a stabilizing member being mounted on the outer cylindrical wall, the end wall and the cylindrical wall cooperating to define a slot extending radially from an exterior surface of the cylindrical wall to a central aperture contained in the end wall; and an ink roller, a first end of which is received and contained within the molded containment member, the ink roller having an outer cylindrical surface and a central bore running therethrough from the first end to a second end of the ink roller, the ink roller being composed of a porous matrix containing ink.

3. A replaceable ink cartridge in accordance with claim 1 wherein the molded containment member is formed from plastic.

4. A replaceable ink cartridge in accordance with claim 1 wherein the slot extending radially from an exterior surface of the cylindrical wall to the central aperture in the end wall of the molded containment member continues through the aperture and remaining portion of the end wall and through at least a portion of the cylindrical wall opposite the initial radial extension of the slot.

5. A replaceable ink cartridge in accordance with claim 4 wherein the molded containment member has an inside diameter being sized to grip and contain the ink roller prior to its insertion o the roller shaft.

6. A replaceable ink cartridge in accordance with claim 5 wherein the inside diameter includes gripping surfaces, the gripping surfaces projecting in toward the central aperture.

7. A replaceable ink cartridge for an imprinting device, the replaceable ink cartridge comprising:

an ink roller having an outer cylindrical surface and a central bore running therethrough from a first end to a second end of the ink roller, the bore being configured to receive a roller shaft therein and the outer cylindrical surface being composed of a porous matrix containing ink; and ink roller containment means mounted to and containing the first end of the ink roller to form the replaceable ink cartridge, the ink roller containment means including mounting means for mounting the replaceable ink cartridge on an imprinting device, stabilizing means for maintaining the ink roller containment means in a stationary position while allowing the ink roller to freely rotate about the roller shaft and pry slot means for removing the ink cartridge from the roller shaft.

8. A replaceable ink cartridge in accordance with claim 7 wherein mounting means includes a central aperture being defined in an end wall, the aperture being configured to engage one end of the roller shaft.

9. A replaceable ink cartridge in accordance with claim 8 wherein the ink roller containment means has an inside diameter being sized to grip and contain the ink roller prior to its insertion on the roller shaft.

10. A replaceable ink cartridge in accordance with claim 9 wherein the inside diameter includes gripping surfaces, the gripping surfaces projecting in toward the central aperture.

11. A replaceable ink cartridge in accordance with claim 7 wherein the pry slot means includes a slot defined within an end wall and cylindrical wall of the ink roller containment means, the slot extending radially from an exterior surface of the cylindrical wall to the central aperture contained in the end wall.

12. A replaceable ink cartridge in accordance with claim 11 wherein the slot extending radially from the exterior surface of the cylindrical wall to the central aperture in the end wall continues through the aperture and remaining portion of the end wall and through at least a portion of the cylindrical wall opposite the initial radial extension of the slot.

13. An imprinting device for imprinting sheet media comprising:

a housing having a base;

a support surface mounted on the base for supporting the sheet media and a plastic card thereon;

a roller shaft mounted on the housing; and an ink cartridge replaceably mounted upon the roller shaft, the ink cartridge including an ink roller having an outer cylindrical surface and a central bore running therethrough from a first end to a second end of the ink roller, the bore being configured to receive the roller shaft therein and the outer cylindrical surface being composed of a porous matrix containing ink, and an ink roller containment member mounted to the first end of the ink roller such that the ink roller is contained on the roller shaft, the ink roller containment member including an aperture which cooperates to receive and contain one end of the roller shaft, a stabilizing member in engagement with the housing such that the ink roller containment member is maintained in a stationary position while allowing the ink roller to freely rotate about the roller shaft and a pry slot extending from an exterior surface of the ink roller containment member to the aperture, wherein, upon insertion of a prying member, the pry slot can be urged apart to remove the ink cartridge from the roller shaft.

14. An imprinting device in accordance with claim 13 wherein the housing includes a carriage, the roller shaft and ink cartridge being slidably mounted on a carriage shaft such that the ink cartridge can be moved laterally across the plastic card and sheet media during printing.

15. An imprinting device in accordance with claim 14 wherein the ink cartridge can be pivoted upwardly to allow the insertion of a plastic card and sheet media onto the support surface.

16. An imprinting device in accordance with claim 15 further including an ink roller carriage mounted to the carriage shaft and surrounding at least a portion of the ink roller.

17. An imprinting device in accordance with claim 16 further including one or more ramps mounted to the base of the imprinting device proximate each end of the support surface, the ramps being configured to maintain the ink cartridge in a fixed horizontal position at each end of the support surface during imprinting.

18. A method for replacing an ink roller on an imprinting device without soiling ones hands or clothing comprising:

(a) providing an imprinting device with a replaceable ink cartridge, the replaceable ink cartridge including an ink roller having an outer cylindrical surface and a central bore running therethrough from a first end to a second end of the ink roller, the bore being configured to receive a roller shaft therein and the outer cylindrical surface being composed of a porous matrix containing ink, and ink roller containment means mounted to and containing the first end of the ink roller to form the replaceable ink cartridge, the ink roller containment means including mounting means for mounting the replaceable ink cartridge on an imprinting device, stabilizing means for maintaining the ink roller containment means in a stationary position while allowing the ink roller to freely rotate about the roller shaft and pry slot means for removing the ink cartridge from the roller shaft, wherein the ink roller of the replaceable ink cartridge is exhausted of ink;

(b) inserting a prying member into the pry slot means;

(c) applying a twisting force to the prying member such that the ink roller containment means breaks and falls away from the ink roller;

(d) discarding the exhausted ink roller; and (e) mounting a new replaceable ink cartridge as provided in (a) above upon the imprinting device, wherein the new replaceable ink cartridge includes a nonexhausted ink roller, and further wherein an individual replacing the ink cartridge grasps the ink roller containment means during mounting.

* * * * *